US005884763A

United States Patent [19]

Ozawa

[11] Patent Number: 5,884,763

[45] Date of Patent: Mar. 23, 1999

[54] WRAPPING FILM HOUSING CARTON

[75] Inventor: Atsuya Ozawa, Shinjuku-Ku, Japan

[73] Assignees: Kureha Kagaku Kogyo Kabushiki Kaisha; Dai Nippon Printing Co., Ltd., both of Tokyo, Japan

[21] Appl. No.: 902,976

[22] Filed: Jul. 30, 1997

[30] Foreign Application Priority Data

Jul. 30, 1996 [JP] Japan ..... 8-200305
Jul. 30, 1996 [JP] Japan ..... 8-200306

[51] Int. Cl.[6] ..... B65D 85/66

[52] U.S. Cl. ..... 206/397; 206/395; 206/813

[58] Field of Search ..... 206/389, 395, 206/397, 455, 460, 813; 225/48, 50

[56] References Cited

U.S. PATENT DOCUMENTS

| | | | |
|---|---|---|---|
| 3,549,066 | 12/1970 | Wankow | 225/48 |
| 3,718,712 | 2/1973 | Tushaus | 269/858 |
| 3,767,040 | 10/1973 | Tushaws | 206/59 C |
| 3,845,894 | 11/1974 | Merlin | 225/48 |
| 3,930,102 | 12/1975 | Müller et al. | 428/354 |
| 4,648,536 | 3/1987 | Vanderlugt | 225/48 |
| 4,661,542 | 4/1987 | Gilch et al. | 524/59 |
| 4,666,072 | 5/1987 | McCarter | 225/25 |
| 5,591,820 | 1/1997 | Kydonieus et al. | 528/76 |

*Primary Examiner*—David T. Fidel
*Attorney, Agent, or Firm*—Loeb & Loeb LLP

[57] ABSTRACT

A wrapping film housing carton of a long type for housing a rolled wrapping film therein, comprising at least cutting means for cutting the wrapping film after drawing out the wrapping film through an opening provided in a longitudinal direction of the carton and a film holding section for preventing the end of the wrapping film after cutting from being rewound into the carton, the film holding section comprising a pressure-sensitive adhesive layer of a cured product of a composition containing a polyurethane prepolymer. This constitution enables the film holding section to be formed by printing. The wrapping film housing carton has good and stable wrapping film holding properties and non-temperature-dependency and can realize a reduction in production cost and simplification and acceleration of the production process.

24 Claims, 3 Drawing Sheets

WRAPPING FILM HOUSING CARTON

BACKGROUND OF THE INVENTION

The present invention relates to a wrapping film housing carton comprising cutting means for cutting a rolled film, such as a wrapping film, and a film holding section for preventing rewinding of the end of the film after cutting and, more particularly to a technique for improving a film holding section which enables simple and efficient formation of the film holding section by printing method and, at the same time, can markedly improve the non-temperature-dependency of the film holding capability.

An example of representative conventional methods for preventing rewinding of the end of a wrapping film after cutting the film in a carton for the wrapping film is as follows. A pressure-sensitive adhesive layer is provided on the surface of a front sheet section constituting a wrapping film housing carton, and a wrapping film housing carton is constructed so that, when the front end of a side overhead cover section glued to a position covering the front sheet section is peeled and removed to open the carton, the pressure-sensitive adhesive layer is exposed onto the surface of the carton, thereby permitting the end of the film after cutting to be held by the pressure-sensitive adhesive layer. In this method, the pressure-sensitive adhesive layer is formed by applying a sticker of the pressure-sensitive adhesive layer onto the surface of the front sheet section.

In the above conventional method using a pressure-sensitive adhesive, however, it is not easy to control the tackiness of the pressure-sensitive adhesive per se, and even slightly excessive tackiness may cause a wrapping film to strongly adhere to the pressure-sensitive adhesive layer, resulting in breakage of the film at the time of drawing out the film. Further, dust is gradually deposited onto the pressure-sensitive adhesive coated face, deteriorating the film holding capability and creating unhygienic conditions.

Furthermore, the conventional pressure-sensitive adhesive has poor printability and coatability and, hence, cannot be easily printed or coated on the housing carton. For this reason, it is common practice to prepare a sticker of a pressure-sensitive adhesive which is then applied to a predetermined position of the housing carton. The preparation of a sticker of the pressure-sensitive adhesive layer renders the production process complicated and, at the same time, is disadvantageous from the viewpoint of cost.

Further, conventional pressure-sensitive adhesives which have been proposed in the art (for example, Japanese Patent Laid-Open Publication No. 270935/1994) are not always satisfactory in the temperature dependency. Specifically, the conventional pressure-sensitive adhesive layer has a very increased tackiness to the film in an ambient temperature range from about 35° to 40° C. or above, disadvantageously making it difficult to peel the film from the pressure-sensitive adhesive layer.

The present invention has been made with a view to solving the problems of the conventional methods involving the construction of a film holding section using the above pressure-sensitive adhesives. An object of the present invention is to provide a wrapping film housing carton which enables formation of a film holding section by printing, possesses a good wrapping film holding property, and stably non-temperature-dependent property, and can realize a reduction in production cost and an improvement toward simple and efficient production.

SUMMARY OF THE PREFERRED EMBODIMENTS

The wrapping film housing carton having a film holding section according to the present invention is characterized in that a film holding section for preventing rewinding the end of a wrapping film after cutting into the carton is constituted by a pressure-sensitive adhesive layer of a specific resin composition excellent in tackiness to the wrapping film, film holding capability, and non-temperature-dependency and that the formation of the pressure-sensitive adhesive layer, unlike the prior art, requires neither any step of forming a sticker of the pressure-sensitive adhesive nor any special curing device and can be done by a simple and efficient process wherein a pressure-sensitive adhesive layer is formed by printing using a conventional gravure printing machine and drying the print, thus resulting in improved performance and productivity.

According to one aspect of the present invention, there is provided a wrapping film housing carton of a long type for housing a rolled wrapping film therein, comprising at least cutting means for cutting the wrapping film after drawing out the wrapping film through an opening provided in a longitudinal direction of the carton and a film holding section for preventing the end of the wrapping film after cutting from being rewound into the carton, the film holding section comprising a pressure-sensitive adhesive layer of a cured product of a composition comprising a curable pressure-sensitive adhesive component of a polyurethane prepolymer.

According to a preferred embodiment of the present invention, the pressure-sensitive adhesive layer constituting the film holding section is formed of a cured product of a mixture of two or more polyurethane prepolymers.

According to a more preferred embodiment of the present invention, the pressure-sensitive adhesive layer constituting the film holding section comprises a cured product of a composition containing, in addition to the curable pressure-sensitive adhesive component of a polyurethane prepolymer, a tackiness control component comprising a nonreactive acrylic resin.

DETAILED DESCRIPTION OF THE PREFERRED EMBODIMENTS

Figure 1:
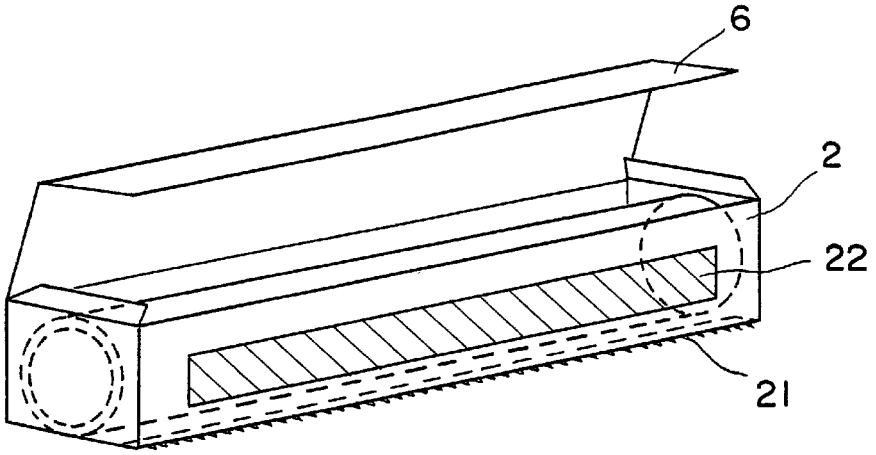
FIGS. 1, 2 and 3 are schematic perspective views of embodiments of the wrapping film housing carton according to the present invention.

The present invention will be described in detail.

Pressure-sensitive adhesive layer

According to the present invention, the film holding section comprises a pressure-sensitive adhesive layer of a cured product of a composition comprising a curable pressure-sensitive adhesive component of a polyurethane prepolymer.

According to the wrapping film housing carton of the present invention, the film holding section for preventing rewinding of the end of the wrapping film into the carton comprises a pressure-sensitive adhesive layer composed mainly of a polyurethane resin having good adhesion to a wrapping film and good capability of holding the wrapping film.

The polyurethane prepolymer in the present invention is such a type that, after coating, a dried pressure-sensitive adhesive layer is formed by heat-removing the solvent component. A moisture-curing polyurethane resin described below can preferably be used. Therefore, the formation of the pressure-sensitive adhesive layer does not require any special device or the like for a crosslinking reaction and can easily be achieved by using a conventional gravure printing machine in the present invention, and the formed pressure-sensitive adhesive layer has excellent film holding capability and temperature nondependency.

According to a preferred embodiment of the present invention, the polyurethane prepolymer constituting the pressure-sensitive adhesive layer of the film holding section is formed of a mixture of two or more prepolymers. In this case, preferably, the mixture of the prepolymers comprises plural kinds of prepolymers, each of which mutually differs in molecular weight and elongation of polyol component. Particularly preferably, the polyurethane prepolymer is selected from prepolymers of which the molecular weight of polyol component constituting the prepolymer is in a range from 1000 to 3000 and of which the elongation is in a range from 20 to 160%.

As described above, according to a preferred embodiment of the present invention, the polyurethane prepolymer constituting the pressure-sensitive adhesive layer of the film holding section comprises a moisture-curing polyurethane resin. In this case, the moisture-curing polyurethane resin refers to a prepolymer which is prepared by urethanizing polyol and isocyanate under a condition of NCO/OH>1, has an isocyanate group in its terminal, and, after coating, can be cured by a reaction with moisture in the air forming a urea bond.

The above polyurethane prepolymer mixture can offer thermal properties which are less likely to depend upon the temperature. Therefore, use of such a mixture as a pressure-sensitive adhesive layer offers an advantage that the pressure-sensitive adhesive layer is less likely to undergo the influence of the environment under which the wrapping film housing carton is used. In particular, the pressure-sensitive adhesive layer can advantageously retain appropriate tackiness even in an environment having a temperature around or above 40° C.

In this case, when the molecular weight of the polyol is large and the elongation is large, the coated layer becomes soft and creates tackiness, improving the adhesion of the film. On the other hand, a reduction in the molecular weight of the polyol and a reduction in the elongation results in increased hardness of the coated layer, reduced tackiness and reduced adhesion to the film. In the pressure-sensitive adhesive layer of the film holding section according to the present invention, too high tackiness is not required, and, rather, low tackiness is preferred. Excessively high tackiness often raises problems such as creation of blocking after the formation of a coating and excessively high adhesion to the wrapping film. For this reason, most preferably, the surface of the pressure-sensitive adhesive layer is even and has relatively low tackiness.

From the viewpoint of easy regulation of the tackiness, the polyurethane resin for providing such a coating is preferably a blend of two polyurethane resins, i.e., a resin having a high molecular weight of polyol and possessing high elongation with a resin having a low molecular weight and possessing low elongation, or alternatively a blend of three polyurethane resins, i.e., the above two resins and a resin of which the molecular weight of the polyol and the elongation are intermediate between the above two resins.

Specifically, the addition of a soft resin having a high molecular weight of polyol and possessing high elongation to a smooth and hard coating of a resin having a high molecular weight of polyol and possessing low elongation permits low tackiness to be imparted, offering suitable film holding capability. Thus, the present inventors have found that the construction of the pressure-sensitive adhesive layer out of a resin containing a resin having a high molecular weight of polyol and possessing high elongation and a resin having a low molecular weight of polyol and possessing low elongation enables low tackiness to be imparted to the pressure-sensitive adhesive layer, making it possible to provide more reliable and stable film holding capability.

For example, in the present invention, preferably, the prepolymer mixture comprises a mixture of at least two prepolymers including (i) a relatively hard polyurethane prepolymer having a molecular weight of polyol of 1000 to 1500 and an elongation of polyol from 20 to 30% and (ii) a relatively soft polyurethane prepolymer having a molecular weight of polyol of 2000 to 2500 and an elongation of polyol from 140 to 150%. In this case, the mixing ratio of the component (i) to the component (ii) is preferably in a range from 50:50 to 30:70.

In an alternative method, a plasticizer or an elastomer may be added to a relatively hard polyurethane prepolymer. For example, the addition of a polyol or a polyurethane prepared by a low degree of addition reaction between a polyol and an isocyanate can increase the elongation and offer intimate contact of the pressure-sensitive adhesive layer to the film, thus imparting good film holding capability.

According to a more preferred embodiment, the pressure-sensitive adhesive layer in the film holding section fundamentally comprises a cured product of a composition containing, in addition to the curable pressure-sensitive adhesive component of a polyurethane prepolymer, a tackiness control component comprising a nonreactive acrylic resin.

Further, according to the present invention, use of a single polyurethane prepolymer of the above type as the curable pressure-sensitive adhesive component suffices for contemplated results. However, it is also possible to use a mixture system of two or more prepolymers.

Further, in the present invention, if necessary, a plasticizer or an elastomer may be added to a relatively hard polyurethane prepolymer. For example, the addition of a polyol or a polyurethane prepared by a low degree of addition reaction between a polyol and an isocyanate can increase the elongation and offer intimate contact of the pressure-sensitive adhesive layer to the film, thus imparting good film holding capability.

In the present invention, the above-mentioned tackiness control component refers to a component which, in itself, does not develop any tackiness and can control the tackiness of the cured product of the polyurethane prepolymer. A nonreactive acrylic resin is preferably used as the tackiness control component. In this case, the nonreactive acrylic resin refers to an acrylic resin which does not substantially react or has low reactivity with a functional group in the urethane. The acrylic resin should be interpreted in a broad sense and connotes the so-called acrylic mixed resin having a polymer unit comprising a combination of acrylic ester group with other group(s).

While there is no intention of being bound by any particular theory, the above nonreactive acrylic resin is considered to control the tackiness through the following mechanism. Specifically, it is generally considered that the polyurethane prepolymer as the curable, pressure-sensitive adhesive component is moisture-cured by a reaction of the isocyanate group (—NCO) in the terminal of the urethane with an —OH group derived from water in the air. In the light of the above property of the polyurethane prepolymer, the present inventor has made studies and, as a result, has found that the presence of an acrylic resin having substantially no or low reactivity with a functional group in the urethane in combination with the polyurethane prepolymer enables the tackiness of the urethane resin coating to be effectively controlled. Specifically, the addition of a nonreactive acrylic resin with the number of —OH groups being small can offer the above advantageous effect. Accordingly, in theory, the nonreactive acrylic resin is ideally one free from —OH group reactive with the isocyanate group in the terminal of the urethane. Since, however, a component for imparting compatibility which renders the composition printable should be incorporated, an acrylic resin component having —OH group should be often used. In this case, the regulation of the content of —OH group in the component is crucial. For example, when the nonreactive acrylic resin comprises a combination of methyl methacrylate with styrene and hydroxyethyl methacrylate, the use of an acrylic resin comprising a polymer unit with the content of —OH group in the hydroxyethyl methacrylate component being regulated to, for example, not more than about 2% as the tackiness control component is preferred. It is considered that use of the above nonreactive acrylic resin in combination with the curable, pressure-sensitive adhesive resin enables the tackiness to be regulated to an optimal state, reduces the temperature dependency of the tackiness and can provide good printability.

In the present invention, although the ratio (solid content ratio) of the curable, pressure-sensitive adhesive component to the tackiness control component may be suitably selected according to the properties and characteristics of the components used, it is preferably in a range from 45:55 to 50:50. The regulation of the ratio to the above range improves good tackiness/peeling aproperty of the pressure-sensitive adhesive layer. That is, in the present invention, use of the above tackiness control component advantageously enables the tackiness of the pressure-sensitive adhesive layer to be easily controlled.

Specifically, in the present invention, the peel strength of the pressure-sensitive adhesive layer as measured under the following conditions is in a range from 7 to 20 g, preferably 10 to 15 g.

A rectangular film (width 25 mm) of polyvinylidene chloride is intimately contacted with the surface of the pressure-sensitive adhesive layer, and the weight (g) necessary for perpendicularly pulling up one end of the film at a pulling rate of 300 mm/min is then measured as the peel strength.

According to the above embodiment, the pressure-sensitive adhesive layer formed is advantageous in that the temperature dependency of the peel strength and a change in tackiness with the elapse of time are small and the tackiness is stable. Particularly advantageously, the pressure-sensitive adhesive layer can maintain appropriate tackiness in an environment having a temperature around or above 40° C.

The pressure-sensitive adhesive layer according to the above embodiment, by virtue of incorporation of a combination of a curable, pressure-sensitive adhesive component with a tackiness control component, is good in the so-called "solvent release" at the time of formation of the pressure-sensitive adhesive layer and has good coatability and printability, rendering this pressure-sensitive adhesive layer advantageous also from the viewpoint of production process.

Formation of pressure-sensitive adhesive layer

In general, a pressure-sensitive adhesive layer having the above composition can be easily formed by dissolving the above components in an organic solvent, adding optional additives, such as a levelling agent, to the solution, using a diluent or the like to render the viscosity and evaporation rate suitable for coating means applied, such as gravure printing to prepare a coating liquid, coating the coating liquid, and drying the coating. Curing of the coating occurs in the course of drying. In the present invention, the term "curing" is intended to mean curing to such an extent that the tackiness contemplated in the present invention can be developed.

The thickness of the pressure-sensitive adhesive layer on a dry basis may be about 2 to 10 $\mu$m, preferably 3 to 6 $\mu$m from the viewpoint of good workability. When the thickness is less than 2 $\mu$m, the surface smoothness is unsatisfactory deteriorating the wrapping film holding property. On the other hand, when it is more than 10 $\mu$m, the wrapping film-holding capability is saturated and, in addition, a lot of time is taken for removing the solvent, unfavorably deteriorating the workability and the productivity.

The position where the pressure-sensitive adhesive layer is provided is not particularly limited so far as the wrapping film, after it is drawn out from the carton body and cut, comes into contact with the carton. In general, however, in cutting the wrapping film, the wrapping film is sandwiched between the front sheet section of the carton and the side overhead cover section followed by cutting of the wrapping film while externally pressing the wrapping film. In this case, the wrapping film is pressed against and, hence, likely to be intimately contacted with the front sheet section of the carton. Therefore, preferably, the pressure-sensitive adhesive layer for holding the film is provided on the surface of the front sheet section. The size and the shape of the pressure-sensitive adhesive layer are also not particularly limited and may be freely determined so that stable film holding capability can be attained by the material of the wrapping film, the shape of the carton, the position where a cutting tool is mounted and the like.

Further, for example, formation of the pressure-sensitive adhesive layer directly in a predetermined position of the carton by coating enables the pressure-sensitive adhesive layer to be formed in line with the step of printing a design onto the carton, which is advantageous from viewpoint of the process. Besides this method, another method may be used wherein a separate sheet with a pressure-sensitive adhesive layer formed thereon by coating is applied to a predetermined position of the carton.

Any conventional wrapping film may be housed in the carton according to the present invention. However, a polyvinylidene chloride film is preferred in consideration of a combination with the pressure-sensitive adhesive layer.

Embodiments of wrapping film housing carton

Embodiments of the wrapping film housing carton according to the present invention will be further described with reference to the accompanying drawings and the drawings of the examples.

In the wrapping film housing carton according to the present invention, the site where the pressure-sensitive adhesive layer of a polyurethane resin serving as the film holding section is provided may vary depending upon the shape of the carton, specifically the form and mounting position of cutting means for cutting the film, and may be suitably selected.

Figure 2:
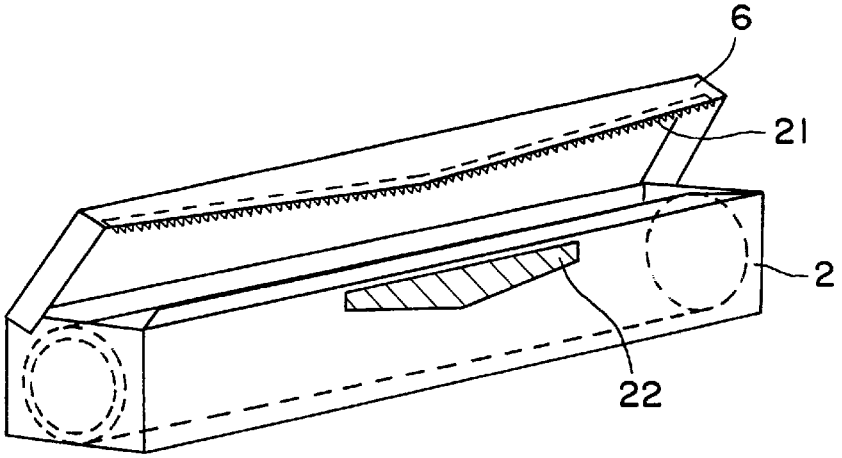
Figure 3:
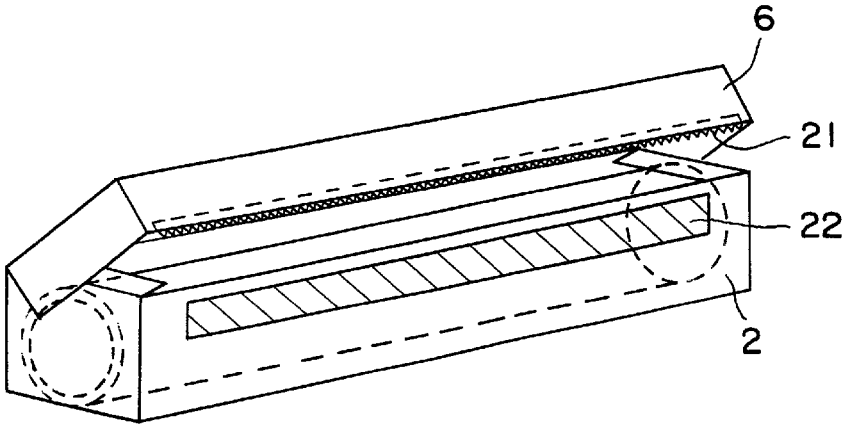

Representative examples of cartons different from one another in form or mounting position of film cutting means are shown in FIGS. 1 to 3. In these drawings, examples of sites, where the pressure-sensitive adhesive layer is formed, suitable for use in combination with the respective forms or mounting positions of the film cutting means are also shown. The site where the pressure-sensitive adhesive layer is formed is preferably in a region including a position where the film is strongly pressed against the surface of the carton, or a region therearound. In this site, upon film cutting operation, the film is automatically pressed against, intimately contacted with, and held by the pressure-sensitive adhesive layer.

Figure 4:
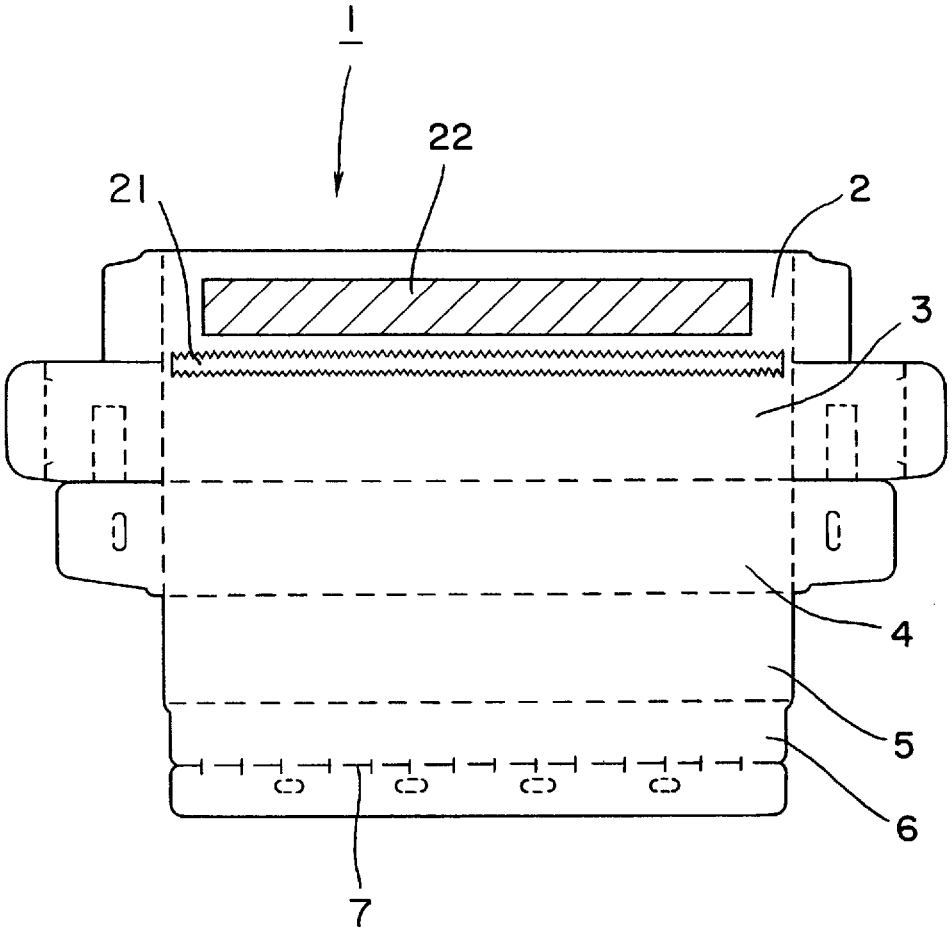
FIG. 4 is a schematic development elevation of the wrapping film housing carton according to the present invention show in FIG. 1.

FIG. 1 is a schematic perspective view showing a first embodiment of the wrapping film housing carton according to the present invention which is in an opened state. FIG. 4 shows a development elevation of this form of carton attended with the designation of each section. The wrapping film housing carton will be described using these designations.

Cartons shown in FIGS. 2 and 3 will also be described using the designations described in FIG. 4.

In the carton shown in FIG. 1, a sawtooth cutting tool 21, when the carton has been assembled, is mounted on the surface of a bottom sheet section 3 (designated in FIG. 4) in such a manner that the edge of the sawtooth cutting tool 21 is slightly projected forward from the bottom sheet section 3 (designated in FIG. 4) of the carton, that is, toward the front sheet section 2 side. In this case, a pressure-sensitive adhesive layer 22 for holding the film is preferably provided as schematically shown in the surface of the front sheet section 2 of the carton. In the above embodiment where the pressure-sensitive adhesive layer is provided in this position, cutting of the drawn wrapping film is performed in such a state that the wrapping film sandwiched between a side overhead cover section 6 and the front sheet section 2 of the carton is manually pressed from the outside of the side overhead cover 6 against the surface of the front sheet section 2. Therefore, the wrapping film is pressed against and can be intimately contacted with the pressure-sensitive adhesive layer.

As with FIG. 1, FIGS. 2 and 3 show an opened state of respective forms of carton. Therefore, the portion (glued portion) in front of the film cutting tool 21 in the side overhead cover section 6 is not shown because, in opening the carton, it has been peeled off and removed by taking advantage of a perforated line 7 (see FIG. 4).

FIG. 2 is a schematic perspective view showing a second embodiment of the wrapping film housing carton according to the present invention. This carton is characterized in that, as shown in the drawing, the sawtooth cutting tool 21 is in a V-shaped form. Therefore, a V-shaped perforated line 7 of the same shape as that of the cutting tool 21 is provided in the side overhead cover section 6. The cutting tool 21 is mounted on the backside of the side overhead cover 6 in its position covering the perforated line so that, when the glued section in front of the perforated line 7 is peeled and removed, the edge of the V-shaped cutting tool 21 is slightly projected. In this embodiment, the wrapping film is cut from the center portion toward both sides of the film while pressing the film in its position near the front end in the V shape of the side overhead cover section. As shown in the drawing, the pressure-sensitive adhesive layer 22 in the film holding section is preferably provided on a slightly upper portion in the center of the surface of the front sheet section 2 of the carton from the viewpoint of facilitating intimate contact of the pressure-sensitive adhesive layer with the film.

FIG. 3 is a schematic perspective view of a third embodiment of the wrapping film housing carton according to the present invention. The sawtooth film cutting tool 21 of this carton, unlike the carton shown in FIG. 2, is of straight type and mounted on the backside of the side overhead cover section 6 in its position covering the straight perforated line provided on the side overhead cover section 6 so that, when the glued section in the front of the perforated line 7 is peeled and removed, the edge of the cutting tool 21 is slightly projected. As shown in the drawing, the pressure-sensitive adhesive layer 22 in the film holding section is provided on the surface of the front sheet section 2 of the carton in its position such that the film is pressed by the side overhead cover section 6 and the film cutting tool 21.

As described above, FIG. 4 is a schematic development elevation of the wrapping film housing carton shown in FIG. 1, according to the present invention, attended with the designation of each section.

Figure 5:
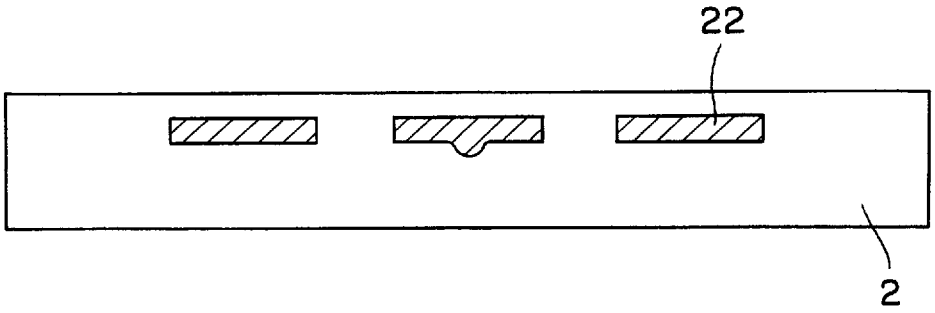
FIG. 5 is a plan view showing a preferred embodiment of a pressure-sensitive adhesive layer provided on the front sheet section of a carton.
Figure 6:
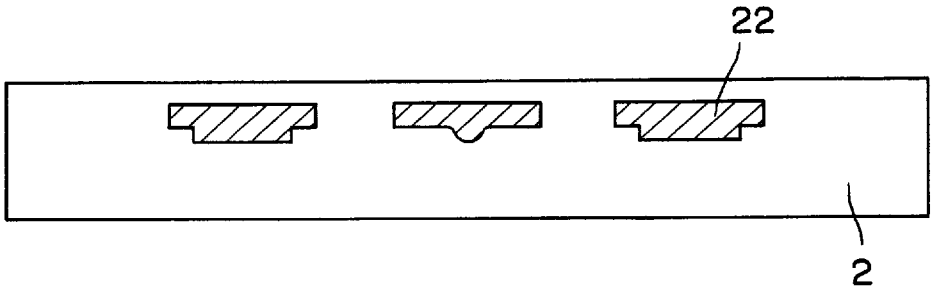
FIG. 6 is a plan view showing another preferred embodiment of a pressure-sensitive adhesive layer provided on the front sheet section of a carton.

FIGS. 5 and 6 are plan views of other preferred embodiments of the pressure-sensitive adhesive layer 22 provided on the front sheet section 2. In these embodiments, varying the width of the pressure-sensitive adhesive layer 22 relative to the widthwise direction of the front sheet section 2, in cooperation with the properties of the material per se of the pressure-sensitive adhesive layer, can offer better film holding performance.

The present invention will be described in more detail with reference to the following specific examples (production examples).

EXAMPLE A1

A coated board (paperboard) having a basis weight of 450 g/m$^2$ was provided as a carton material. Using an in-line apparatus for rotogravure printing blanking, a predetermined pattern and an overprint varnish were printed, and, in line with the above printing, a coating liquid having the following composition was coated onto a carton in its position shown in FIG. 2 to a thickness on a dry basis of 3 $\mu$m followed by drying to form a film holding pressure-sensitive adhesive layer 22, and blanking was performed using a blanking die for a carton shown in FIG. 2 to prepare a carton blank. Subsequently, a V-shaped, sawtooth cutting tool 21 was mounted on the carton in its position shown in FIG. 2 by means of a special device. Further, a sack applicator was used to perform application [the surface of the front sheet section 2 and the backside of a gluing portion in the front of a perforated line 7 (see FIG. 4) in a side overhead cover section 6 for covering the surface of the front sheet section 2 being applied to each other in a longitudinal direction thereof] to prepare a wrapping film housing carton of Example A1.

| Composition of coating liquid for film holding pressure-sensitive adhesive layer | |
|---|---|
| (1) Polyurethane resin (molecular weight of polyol 1000 to 1500, elongation 22%) solution (solid content 30% by weight) | 50 parts by weight |
| (2) Polyurethane resin (molecular weight of polyol 2000 to 2500, elongation 145%) solution (solid content 30% by weight) | 50 parts by weight |
| (3) Diluting solvent (toluene/methyl ethyl ketone weight ratio 1:1) | 40 parts by weight |

EXAMPLE A2

A wrapping film housing carton of Example A2 was prepared in the same manner as in Example A1, except that, in the construction of the wrapping film housing carton of Example A1, a coating liquid having the following composition was coated and dried instead of the coating liquid having the composition for the film holding pressure-sensitive adhesive layer used in Example A1.

| Composition of coating liquid for film holding pressure-sensitive adhesive layer | |
|---|---|
| (1) Polyurethane resin (molecular weight of polyol 1000 to 1500, elongation 22%) solution (solid content 30% by weight) | 70 parts by weight |
| (2) Polyurethane resin (molecular weight of polyol 2000 to 2500, elongation 145%) solution (solid content 30% by weight) | 30 parts by weight |
| (3) Diluting solvent (toluene/methyl ethyl ketone weight ratio 1:1) | 40 parts by weight |

EXAMPLE A3

A wrapping film housing carton of Example A3 was prepared in the same manner as in Example A1, except that, in the construction of the wrapping film housing carton of Example A1, a coating liquid having the following composition was coated and dried instead of the coating liquid having the composition for the film holding pressure-sensitive adhesive layer used in Example A1.

| Composition of coating liquid for film holding pressure-sensitive adhesive layer | |
|---|---|
| (1) Polyurethane resin (molecular weight of polyol 1500 to 2000, elongation 110%) solution (solid content 30% by weight) | 100 parts by weight |
| (2) Diluting solvent (toluene/methyl ethyl ketone weight ratio 1:1) | 40 parts by weight |

As a result, for the wrapping film housing cartons of Examples A1 to A3, the adhesion to a wrapping film of a polyethylene resin and a wrapping film of a polymethylpentene resin was slightly low, while the adhesion to a wrapping film of a polyvinylidene chloride and a wrapping film of a polyvinyl chloride resin was good posing no problem and, at the same time, did not advantageously change with the elapse of time.

The results of evaluation on the temperature dependency of peel strength (g) and the change of the peel strength with the elapse of time will be summarized below.

For comparison, the results of evaluation on the formation of a pressure-sensitive adhesive layer using TSS KL-D2 (a product prepared by graft-polymerizing a vinyl chloride monomer onto an ethylene/vinyl acetate copolymer to prepare a graft copolymer and adding an acrylic resin to the graft copolymer; see Japanese Patent Laid-Open No. 270935/1994) will be also summarized below (Comparative Example A).

| | Measured immediately | Measured 24 hr after application | | |
|---|---|---|---|---|
| | after application | Room temp. | 5° C. | 40° C. |
| Ex. A1 | 3.5 | 4.1 | 3.7 | 2.5 |
| Ex. A2 | 2.7 | 3.2 | 2.9 | 2.8 |
| Ex. A3 | 1.5 | 2.8 | 3.2 | 3.1 |
| Comp.Ex. A | 68 | 94 | 65 | 247 |

As is apparent from the above description and the results of the examples and the comparative example, the present invention has the following effects.

In the wrapping film housing carton according to the present invention, a film holding section for preventing rewinding of the film end is constituted by a pressure-sensitive adhesive layer of a resin, and the shape of the carton (area, used, of paperboard), usage and the like may be the same as used in the prior art, requiring no extra cost and operation.

Further, for the formation of a pressure-sensitive adhesive layer for holding the film, a composition is used which has coatability and printability good enough to form a dried coating simply by coating a coating liquid for the pressure-sensitive adhesive layer and heat-drying the coating to remove the solvent component. Therefore, unlike the prior art, the formation of the pressure-sensitive adhesive layer does not require the step of forming a sticker of a pressure-sensitive adhesive layer and does not require any special curing device, and a pressure-sensitive adhesive layer can be easily and rapidly formed using a conventional gravure printing machine. Accordingly, processing in line with the printing of a design is possible, offering good productivity, facilitating the production of the wrapping film housing carton, and offering an advantage associated with the cost.

The formed pressure-sensitive adhesive layer possesses excellent tackiness to the wrapping film and, in addition, has low temperature dependency of the peel strength and small change in peel strength with the elapse of time, that is, possesses stable tackiness.

Further, since the pressure-sensitive adhesive layer is formed of a combination of a plurality of components, tackiness/peel strength of the pressure-sensitive adhesive layer can be improved by regulating the blending ratio of the components.

As described above, according to the present invention, a wrapping film housing carton having a film holding section can be easily provided which is low in cost and has excellent productivity and performance.

EXAMPLE B1

A coated board (paperboard) having a basis weight of 450 g/m$^2$ was provided as a carton material. Using an in-line apparatus for rotogravure printing blanking, a predetermined pattern and an overprint varnish were printed, and, in line with the above printing, a coating liquid having the following composition was coated onto a carton in its position shown in FIG. 2 to a thickness on a dry basis of 3 $\mu$m followed by drying to form a film holding pressure-sensitive adhesive layer 22, and blanking was performed using a blanking die for a carton shown in FIG. 2 to prepare a carton blank. Subsequently, a V-shaped, sawtooth cutting tool 21 was mounted on the carton in its position shown in FIG. 2 by means of a special device. Further, a sack applicator was used to perform application [the surface of the front sheet section 2 and the backside of a gluing portion in the front of a perforated line 7 (see FIG. 4) in a side overhead cover section 6 for covering the surface of the front sheet section 2 being applied to each other in a longitudinal direction thereof] to prepare a wrapping film housing carton of Example B1.

The coating liquid for a film holding pressure-sensitive adhesive layer had the following composition. In this connection, the blending ratio of the polyurethane prepolymer to the nonreactive acrylic resin was varied, and the peel strength was measured.

(1) Polyurethane prepolymer (molecular weight of polyol 1500 to 2000, elongation 160%) solution (solid content 50% by weight)

(2) Nonreactive acrylic resin solution (solid content 50% by weight)

(3) Diluting solvent: ethyl acetate 100 parts by weight of solutions having component (1) to component (2) ratios of 55:45, 50:50, 45:55, and 40:60 were mixed with and diluted by 30 parts by weight of the component (3).

The peel strength was measured under the following conditions.

At the outset, a rectangular film (width 25 mm) of polyvinylidene chloride was applied to the surface of the pressure-sensitive adhesive layer, and the weight (g) necessary for perpendicularly pulling up one end of the film at a pulling speed of 300 mm/min was measured.

The results of the peeling test (at room temperature) are summarized as follows.

| | Polyurethane prepolymer/ nonreactive acrylic resin | Peel strength (g) Min.-max. | Peel strength (g) Average |
|---|---|---|---|
| No. 1 | 55/45 | 13.2–23.0 | 18.56 |
| No. 2 | 50/50 | 11.0–15.0 | 12.08 |
| No. 3 | 45/55 | 7.0–9.4 | 8.44 |
| No. 4 | 40/60 | 5.2–7.0 | 5.76 |

As described above, the peel strength/tackiness can be regulated to a good range by regulating the blending ratio of the polyurethane prepolymer to the nonreactive acrylic resin.

For the sample Nos. 1 to 4, the temperature dependency of the peel strength (g) and a change in the peel strength with the elapse of time were evaluated, and the results are summarized in the following table.

| | Immediately after production | | | 1 day after production | | |
|---|---|---|---|---|---|---|
| | Room temp. | 5° C. | 40° C. | Room temp. | 5° C. | 40° C. |
| No. 1 | 19 | 7 | 18 | Failure | 25 | Failure |
| No. 2 | 12 | 8 | 10 | 25 | 15 | 30 |
| No. 3 | 8 | 5 | 8 | 22 | 11 | 16 |
| No. 4 | 6 | 4 | 4 | 15 | 6 | 14 |

EXAMPLE B2

A pressure-sensitive adhesive layer was formed and subjected to a peel test in the same manner as in Example B1, except that the coating liquid for the pressuresensitive adhesive layer had the following composition with the blending ratio of the polyurethane prepolymer to the nonreactive acrylic resin ratio being 50:25 (solid content ratio).

| | |
|---|---|
| (1) Polyurethane prepolymer (molecular weight of polyol 1500 to 2000, elongation 180%) solution (solid content 50% by weight) | 100 parts by weight |
| (2) Nonreactive acrylic resin solution (solid content 25% by weight) | 100 parts by weight |
| (3) Diluting solvent: ethyl acetate | 40 parts by weight |

The peeling property (peel strength) was measured under the following conditions.

The central portion of the pressure-sensitive adhesive layer was cut in a width of 40 mm, and a rectangular film (width 25 mm) of polyvinylidene chloride was applied to and intimately contacted with the pressure-sensitive adhesive layer. The weight (g) necessary for perpendicularly pulling up one end of the film at a pulling speed of 300 mm/min was measured.

The results of evaluation on the temperature dependency of the peel strength (g) and a change in the peel strength with the elapse of time are summarized below.

For comparison, the results of evaluation on the formation of a pressure-sensitive adhesive layer using TSS KL-D2 (a product prepared by graft-polymerizing a vinyl chloride monomer onto an ethylene/vinyl acetate copolymer to prepare a graft copolymer and adding an acrylic resin to the graft copolymer; see Japanese Patent Laid-Open No. 270935/1994) will be also summarized below (Comparative Example B1).

| | Measured immediately after application | | | Measured 1 day after application | | | Measured 5 days after application | | |
|---|---|---|---|---|---|---|---|---|---|
| | Room temp. | 5° C. | 40° C. | Room temp. | 5° C. | 40° C. | Room temp. | 5° C. | 40° C. |
| Ex. B1 | 20 | 10 | 20 | 25 | 18 | 24 | 28 | 20 | 26 |
| Ex. B2 | 10 | 9 | 11 | 14 | 14 | 18 | 16 | 14 | 20 |
| Comp. Ex. B1 | 68 | 52 | 146 | 94 | 65 | 247 | 112 | 58 | 284 |

A wrapping film of a polyvinylidene chloride resin, a wrapping film of a polyvinyl chloride resin, a wrapping film of a polyethylene resin, and a wrapping film of a polymethylpentene resin were separately housed and packed in the wrapping film housing cartons of the examples and the comparative example. The packages were then opened, and a series of procedures consisting of drawing out and cutting the wrapping film were repeated three times per day for 30 days to evaluate the holding of the wrapping film onto the film holding section by taking advantage of the tackiness of the pressure-sensitive adhesive layer, the repeelability of the wrapping film from the film holding section, temperature dependency of the film holding capability and repeelability, and a change in holding capability and repeelability with the elapse of time.

As a result, the pressure-sensitive adhesive layer in the wrapping film housing cartons of the examples had low adhesion to the wrapping film of a polyethylene resin and the wrapping film of a polymethylpentene resin was slightly low, while it had good adhesion to the wrapping film of a polyvinylidene chloride resin and the wrapping film of a polyvinyl chloride resin without posing any problem and the adhesion did not change with the elapse of time.

On the other hand, for the comparative wrapping film housing carton, the pressure-sensitive adhesive layer had poor adhesion to the wrapping film of a polyvinyl chloride resin and no adhesion to the other wrapping films, and the film holding property was unsatisfactory.

As is apparent from the above description and the results of the examples and the comparative example, the present invention has the following effects.

In the wrapping film housing carton according to the present invention, a film holding section for preventing rewinding of the film end is constituted by a pressure-sensitive adhesive layer of a resin, and the shape of the carton (area, used, of paperboard), usage and the like may be the same as used in the prior art, requiring no extra cost and operation.

Further, for the formation of a pressure-sensitive adhesive layer for holding the film, a composition is used which has coatability and printability good enough to form a dried coating simply by coating a coating liquid for the pressure-sensitive adhesive layer and heat-drying the coating to remove the solvent component. Therefore, unlike the prior art, the formation of the pressure-sensitive adhesive layer does not require the step of forming a sticker of a pressure-sensitive adhesive layer and does not require any special curing device, and a pressure-sensitive adhesive layer can be easily and rapidly formed using a conventional gravure printing machine. Accordingly, processing in line with the printing of a design is possible, offering good productivity, facilitating the production of the wrapping film housing carton, and offering an advantage associated with the cost.

The formed pressure-sensitive adhesive layer possesses excellent tackiness to the wrapping film and, in addition, has very low temperature dependency of the peel strength and small change in peel strength with the elapse of time, that is, possesses stable tackiness.

Further, since the pressure-sensitive adhesive layer is formed of a combination of a curable, pressure-sensitive adhesive component with a tackiness control component, tackiness/peel strength of the pressure-sensitive adhesive layer can be improved. For example, in the present invention, use of the above tackiness control component can advantageously permit the tackiness of the pressure-sensitive adhesive layer to be easily controlled. Further, as described above, the pressure-sensitive adhesive layer has very low temperature dependency of the peel strength and undergoes only a small change of the peel strength with the elapse of time, that is, advantageously has stable adhesive properties. Further, use of a curable, pressure-sensitive adhesive component in combination with a tackiness control component offers good solvent release at the time of the formation of the pressure-sensitive adhesive layer and a good coating property, which are advantageous from the viewpoint of the production process.

Thus, the present invention has the effect of easily providing a wrapping film housing carton having a film holding section which is low in cost and excellent in both the productivity and the performance.

I claim:

1. A wrapping film housing carton, comprising a cutter for cutting the wrapping film after drawing out the wrapping film through an opening provided in a longitudinal direction of the carton and a film holding section for preventing the end of the wrapping film after cutting from being rewound into the carton, the film holding section further comprising a pressure-sensitive adhesive layer of a heat-cured or moisture-cured product of a composition comprising a curable pressure-sensitive adhesive component of a polyurethane prepolymer having a polyol component with a molecular weight in a range from 1000 to 3000 and an elongation in a range from 20 to 160%.

2. The wrapping film housing carton according to claim 1, wherein the pressure-sensitive adhesive layer constituting the film holding section is formed of a cured product of a mixture of two or more polyurethane prepolymers.

3. The wrapping film housing carton according to claim 2, wherein the mixture of the prepolymers comprises plural kinds of prepolymers, each of which mutually differs in molecular weight and elongation of polyol component.

4. The wrapping film housing carton according to claim 2, wherein the mixture of the prepolymers comprises a mixture of at least two different kinds of prepolymers including (i) a polyurethane prepolymer having a molecular weight of polyol from 1000 to 1500 and an elongation of polyol from 20 to 30% and (ii) a polyurethane prepolymer having a molecular weight of polyol from 2000 to 2500 and an elongation of polyol from 140 to 150%.

5. The wrapping film housing carton according to claim 1, wherein the polyurethane prepolymer comprises a moisture-curing polyurethane resin.

6. The wrapping film housing carton according to claim 5, wherein the moisture-curing polyurethane resin is a prepolymer which is prepared by urethanizing polyol and isocyanate under a condition of NCO/OH>1, has an isocyanate group in its terminal, and, after coating, can be cured by a reaction with moisture in the air forming a urea bond.

7. The wrapping film housing carton according to claim 1, wherein the polyurethane prepolymer comprising the composition further comprises a curable elastomer.

8. The wrapping film housing carton according to claim 1, wherein the wrapping film to be housed in the carton is a polyvinylidene chloride film.

9. The wrapping film housing carton according to claim 1, wherein the film holding section constructed of a pressure-sensitive adhesive layer formed of a composition comprising a curable pressure-sensitive adhesive component of a polyurethane prepolymer has been formed by printing on the surface of a front sheet section of the wrapping film housing carton.

10. The wrapping film housing carton according to claim 1, wherein the pressure-sensitive adhesive layer further comprises a tackiness control component comprising a non-reactive acrylic resin.

11. The wrapping film housing carton according to claim 10, wherein the polyurethane prepolymer comprises a moisture-curing polyurethane resin.

12. The wrapping film housing carton according to claim 11, wherein the moisture-curing polyurethane resin is a prepolymer which is prepared by urethanizing polyol and isocyanate under a condition of NCO/OH>1, has an isocyanate group in its terminal, and, after coating, can be cured by a reaction with moisture in the air forming a urea bond.

13. The wrapping film housing carton according to claim 10, wherein the composition further comprises a curable elastomer.

14. The wrapping film housing carton according to claim 10, wherein the tackiness control component comprises a mixture of methyl methacrylate, styrene, and hydroxyethyl methacrylate.

15. The wrapping film housing carton according to claim 14, wherein the tackiness control component comprises a polymer unit with a content of OH group in the hydroxyethyl methacrylate of not more than 2%.

16. The wrapping film housing carton according to claim 10, wherein the wrapping film to be housed in the carton is a polyvinylidene chloride film.

17. The wrapping film housing carton according to claim 10, wherein the pressure-sensitive adhesive layer formed of the cured product of a polyurethane prepolymer has been formed by printing.

18. The wrapping film housing carton according to claim 10, wherein the pressure-sensitive adhesive layer develops stable adhesion in both environmental temperatures of room temperature and 40° C.

19. A pressure-sensitive adhesive layer comprising a heat-cured or moisture-cured product of a composition comprising a curable pressure-sensitive adhesive component of a polyurethane prepolymer printed in a film holding section on a surface of a front sheet section of a wrapping film housing carton.

20. The wrapping film housing carton according to claim 4, wherein prepolymer (i) and prepolymer (ii) are present respectively in the mixture in a ratio in a range from 50:50 to 30:70.

21. The wrapping film housing carton according to claim 10, wherein the pressuresensitive adhesive component and the tackiness control component are present respectively in a ratio in a range from 45:55 to 50:50.

22. A wrapping film housing carton, comprising a cutter for cutting the wrapping film after drawing out the wrapping film through an opening provided in a longitudinal direction of the carton and a film holding section for preventing the end of the wrapping film after cutting from being rewound into the carton, the film holding section further comprising a pressure-sensitive adhesive layer of a heat-cured or moisture-cured product of a composition comprising a curable pressure-sensitive adhesive component of a polyurethane prepolymer, the pressure-sensitive adhesive layer having a peel strength in a range from 7 to 20 g for a film width of 25 mm and a pulling speed of 300 mm/nin.

23. The wrapping film housing carton according to claim 22, wherein the pressuresensitive adhesive layer has a peel strength in a range from 10 to 15 g.

24. A wrapping film housing carton storing a wrapping film made of polyvinylidene chloride resin rolled on a cylindrical core, the carton comprising a cutter for cutting the wrapping film after drawing out the wrapping film through an opening provided in a longitudinal direction of the carton and a film holding section for preventing after cutting the end of the wrapping film from being rewound into the carton, the film holding section further comprising a pressure-sensitive adhesive layer of a heat-cured or moisture-cured product of a composition comprising a curable pressure-sensitive adhesive component of a polyurethane prepolymer.

* * * * *